US009770644B2

(12) United States Patent
Poisson et al.

(10) Patent No.: US 9,770,644 B2
(45) Date of Patent: Sep. 26, 2017

(54) AIR-PERMEABLE ADAPTABLE MOUTHGUARD HAVING CLAMPED JAWS

(75) Inventors: Philippe Poisson, Saint-Seurin-sur-l'Isle (FR); Herve Ohrensstein, Creon (FR)

(73) Assignees: UNIVERSITE VICTOR SEGALEN-BORDEAUX 2, Bordeaux (FR); Herve Ohrensstein, Creon (FR)

( * ) Notice: Subject to any disclaimer, the term of this patent is extended or adjusted under 35 U.S.C. 154(b) by 391 days.

(21) Appl. No.: 13/988,106

(22) PCT Filed: Nov. 17, 2011

(86) PCT No.: PCT/FR2011/052682

§ 371 (c)(1),
(2), (4) Date: Aug. 5, 2013

(87) PCT Pub. No.: WO2012/066248

PCT Pub. Date: May 24, 2012

(65) Prior Publication Data

US 2013/0298917 A1 Nov. 14, 2013

(30) Foreign Application Priority Data

Nov. 19, 2010 (FR) ..... 10 59531

(51) Int. Cl.
*A63B 71/08* (2006.01)

(52) U.S. Cl.
CPC ..... *A63B 71/085* (2013.01)

(58) Field of Classification Search
CPC ..... A63B 71/085
USPC ..... 433/6, 2; 128/846, 857, 859, 861
See application file for complete search history.

(56) References Cited

U.S. PATENT DOCUMENTS

| | | | | |
|---|---|---|---|---|
| 5,339,832 | A | 8/1994 | Kittelsen et al. | |
| 5,636,379 | A | 6/1997 | Williams | |
| 6,082,363 | A * | 7/2000 | Washburn | A63B 71/085 128/859 |
| 6,109,266 | A | 8/2000 | Turchetti | |
| 2004/0107970 | A1 | 6/2004 | Kittelsen et al. | |
| 2004/0250817 | A1 * | 12/2004 | Kittelsen et al. | 128/861 |
| 2009/0223526 | A1 * | 9/2009 | Berghash | A63B 71/085 128/861 |
| 2010/0055634 | A1 * | 3/2010 | Spaulding | A61C 7/00 433/5 |

FOREIGN PATENT DOCUMENTS

| | | | |
|---|---|---|---|
| EP | 1398061 | A2 | 3/2004 |
| FR | 2788962 | A1 | 8/2000 |
| JP | H0528373 | U | 4/1993 |
| JP | H1142311 | A | 2/1999 |

* cited by examiner

*Primary Examiner* — Tarla Patel
(74) *Attorney, Agent, or Firm* — Bachman & LaPointe, P.C.

(57) ABSTRACT

A mouthguard able to be shaped in the mouth, has an adaptable structure consisting of an adaptable material, and a skeleton, at least partially covered by the adaptable structure, consisting of a non-adaptable material. The mouthguard also has a removable pallet consisting of a non-adaptable material and comprising a first region intended to butt against the skeleton, the region of the pallet being dimensioned such that, during the adaptation phase of the mouthguard, the combined presence of the pallet and of the skeleton ensures both ventilation space and the presence of sufficient material at the incisor-canine area.

11 Claims, 8 Drawing Sheets

AIR-PERMEABLE ADAPTABLE MOUTHGUARD HAVING CLAMPED JAWS

BACKGROUND

The present invention relates, generally, to the field of adaptable mouthguards for protecting subjects against the effects of a craniofacial impact.

The term "adaptable" refers to mouthguards suitable for being shaped in the mouth.

The present invention particularly, but not exclusively, relates to mouthguards suitable for adaptation by means of thermal adaptation with hot water.

The present invention is used, more particularly, but not exclusively, when practising sports involving a risk of orodental, maxillo-facial, brain and neck injuries. It may relate to other fields such as for example that of healthcare for preventing orodental injuries liable to occur during endotracheal intubation.

Sport is one of the main causes of orodental injuries. The American Dental Association and the Academy for Sports Dentistry have drawn up a list of at-risk sports and leisure activities for which they recommend the use of a suitable mouthguard, such as, for example, martial arts, baseball, basketball, boxing, cycling, football, gymnastics, weightlifting, handball, hockey, wrestling, parachuting, rugby, skateboarding, skiing, equestrian sports, squash, surfing, volleyball or water polo.

Mouthguards emerged in the 1890s in the UK and originally were intended to protect boxers from cuts to the lips caused by practising their sport.

From the first role thereof as a protection of the mucosa, the mouthguard has evolved to become primarily a protection of the orodental and maxillary structures, and the role thereof has extended to the prevention of concussion and neck injuries while practising at-risk sports.

Therefore, among other things, a mouthguard is intended to:

- reduce the risk of injury to soft tissue (tongue, lips and cheeks);
- reduce the risk of injury to maxillary front teeth;
- reduce the risk of orodental injury due to a violent inter-arch impact;
- reduce the risk of concussion;
- reduce the risk of neck injury.

Furthermore, a mouthguard includes the following properties:

- occupying areas with no teeth;
- enabling an engagement of the mandibular and maxillary dental arches;
- being comfortable;
- not exhibiting any protrusions or roughness;
- being retentive;
- absorbing and dissipating impact energy;
- enabling phonation;
- enabling oral ventilation with the jaws clamped shut.

The term "retentive" refers to the ability of the mouthguard to remain in place when the user opens his/her mouth.

The term "engagement" refers to the entry of the antagonist teeth into the occlusal rim of the cradle to obtain the alignment of the mandibular and maxillary arches.

The term "phonation" refers to the user's ability to express themselves verbally.

Three types of mouthguard are currently routinely offered:

- Type I: standard model, uni- or bimaxillary. This type of mouthguard is ready-to-use. However, such a mouthguard involves the following drawbacks:
  - not enabling the engagement of the mandibular and maxillary dental arches;
  - not being retentive: it only holds in place when the player's jaws are clamped shut;
  - impeding the player's ventilation and, furthermore, there is a risk of the guard being ejected during exertion and getting stuck in the player's airways.
- Type II: adaptable model, uni- or bimaxillary. This type of mouthguard is suitable for being shaped in the user's mouth. However, such a mouthguard involves the following drawbacks:
  - losing up to 99% of the thickness during the adaptation in the mouth, limiting impact energy absorption and dissipation;
  - restricting oral ventilation with the jaws clamped shut.
- Type III: custom model. This type of mouthguard is produced after taking imprints of the user's mandibular and maxillary dental arches. The (custom) preparation method should be suitable for producing a high-quality mouthguard according to the objective essential criteria and recognised properties for this prevention device. However, according to the operators, some of these mouthguards may have a lower quality than type II cradles in terms of material thickness and ventilation capacity with the jaws clamped shut.

Type II mouthguards, i.e. suitable for being shaped in the mouth, for example after softening in hot water, represent more than 90% of the mouthguards currently worn by athletes.

Retention of the thicknesses of the mouthguard material is necessary for satisfactory absorption and dissipation of impact-related energies.

Furthermore, ventilatory studies have demonstrated that all types of mouthguards involved more air resistance and reduced the athlete's ability to ventilate with the jaws clamped shut.

This reduction in ventilation with the jaws clamped shut gives rise to hypoxia, hypercapnia and the logical result is a decline in performance.

This reduction in ventilation with the jaws clamped shut gives rise to a mouth opening movement which is essential to reduce the hypoxia and hypercapnia induced by the exertion with the jaws clamped shut. However, this movement causes two major consequences:

- an increased risk of injuries after impact on a mandible detached from the face, referred to as "projectile mandible", such as dental injuries due to inter-arch impact, predominantly postural knockout or mandibular fracture following impact of the posterior region of the temporal eminence of the condylar process.
- an increased risk of concussion and cervical spine injury due to a shock to the muscle support for the craniofacial joint and thus an impairment in head and neck support.

The aim is thus that of providing an adaptable mouthguard for ensuring oral ventilation when the user's jaws are clamped shut and retention of mouthguard thicknesses after the intra-oral shaping procedure.

Of the numerous patents relating to mouthguards, the international patent application WO94/27691 held by E-Z GARD INDUSTRIES, published on 8 Dec. 1994, subject to the priority of an American applications U.S. Ser. No. 08/066,468 filed on May 1993 is known. This application discloses a guard made of composite material, comprising a maxillary cradle made of a thermo-adaptable material and frame made of a non-thermo-adaptable material for absorbing and dissipating impact forces. The structure of this type II mouthguard enables posterior contact (i.e. to the rear of the jaw) on the non-thermo-adaptable material to retain a frontal space (i.e. to the front of the mouth, at the incisors) to breathe and talk. However, the frontal space obtained after shaping the mouthguard may be insufficient to enable satisfactory ventilation when the user clamps the jaws shut. Moreover, the presence of only the non-thermo-adaptable material in regard to the lateral sectors means it is impossible to take an imprint of the mandibular dental arch during the shaping procedure and thus does not enable engagement between the mandibular and maxillary dental arches.

However, athletes need sufficient ventilation while exerting themselves with the jaws clamped shut and the mandible to be correctly engaged and interlocked with the maxillary dental arch to prevent the "projectile mandible" phenomenon.

The international patent application WO98/34574 filed in February 1997 on behalf of WIPSS PRODUCTS INC subject to the priority of an American application U.S. Pat. No. 5,636,379 filed in August 1995 also disclosing a guard made of composite material is also known. One of the drawbacks of this product is that the thinness of the thermo-adaptable material around the frame made of non-thermo-adaptable material does not enable sufficient engagement between the mandibular and maxillary dental arches during the shaping procedure and thus does not enable sufficient locking of the mandible or sufficient mouthguard retention.

SUMMARY OF THE INVENTION

The aim of the invention is that of remedying these drawbacks by providing a mouthguard which, after the shaping procedure, enables effective ventilation with the jaws clamped shut regardless of the athlete's dento-maxillofacial typology, while retaining the minimum material thicknesses for an optimal role of the mouthguard in preventing orodental, maxillofacial, brain and neck injuries.

For this purpose, according to a first embodiment, the invention relates to a mouthguard, suitable for being shaped in the mouth, and comprising:

- an adaptable structure, consisting of an adaptable material, having an upper splint for receiving the maxillary dental arch, and a lower splint for receiving the mandibular dental arch,
- a frame, at least partially covered by the adaptable structure, consisting of a non-adaptable material,
- the adaptable structure and the frame being arranged to form
- an incisor-canine guard area at least at the upper canines and incisors,
- and an occlusal rim at each lateral dental sector, i.e. at the upper and lower premolars and molars on either side, and further comprising a removable pallet, consisting of a non-adaptable material, comprising a first region intended to butt against the frame, preferably is the incisor-canine area, and not necessarily in direct contact, said region of the pallet being dimensioned such that, during the mouthguard adaptation phase, the combined presence of said pallet and said frame ensures both a ventilation space and the presence of sufficient material in the incisor-canine area.

The term "adaptable material" denotes that the material becomes malleable during the mouthguard adaptation process.

The term "butt" denotes that the pallet engages with the frame to enable both a sufficient material thickness in the incisor-canine area and a sufficient ventilation space for satisfactory user ventilation. Consequently, there may be a layer of thermo-adaptable material between the pallet and the frame (implying abutment without direct contact) without lessening the effects of the interaction between the pallet and the frame.

The adaptation of the mouthguard uses, for example, a thermo-adaptation technique by softening the material with hot water to enable adaptation to the user's mouth.

In the absence of a frame, when the user clamps the jaws shut during the shaping procedure, the teeth penetrate into the adaptable structure without being able to control the thicknesses. If the material thicknesses are not sufficient, the mouthguard no longer fulfils the role thereof. Maintaining minimum thicknesses, which are reproducible for all athletes, promotes impact energy absorption and dissipation by the composite material of the guard. Moreover, in the absence of the pallet, the compression of the mandibular and maxillary splints during mouthguard adaptation is not suitable for retaining a sufficient frontal space for effective user ventilation.

The term "splint" denotes the volume of adaptable material for receiving the upper and lower dental arches. In this way, prior to mouthguard adaptation, the upper and lower splints have even surfaces, and after mouthguard adaptation, the upper and lower splints exhibit the imprints of the teeth.

The splints thus initially have sufficient thicknesses so that the adaptable material of the adaptable structure can fill a gap left by a missing tooth, and all the teeth are covered by the adaptable material to be effectively protected, ensure the retention of the mouthguard and interlock the mandibular dental arch with the maxillary dental arch.

This first region of the pallet may have various shapes. It may, for example, be flat, but also plane-convex or biconvex.

The first region of the pallet thus has a length L, a width l and a height h. Once the mouthguard is in the mouth, the length L can be defined as the dimension extending from the outside to the inside of the mouth, the width l as the dimension extending from one canine to another, and the height h is the thickness of the pallet, i.e. the dimension is suitable for defining the opening of the jaws, the free space between the maxillary teeth and the mandibular teeth.

Advantageously, the first region of the pallet has a cross-section having a surface area approximately greater than or equal to 30 square millimeters.

The ventilation space created is sufficient and necessary for satisfactory user ventilation, particularly during exertion. Below this value, the user cannot ventilate sufficiently and is thus required to open the mouth, giving rise to the drawbacks mentioned above.

The complementary function between the non-adaptable pallet and frame makes it possible to, effectively and reproducibly, address the two main problems encountered in existing guards, i.e.:

- ensuring retention of minimum thicknesses so that the mouthguard absorbs and dissipates the impact energy effectively,
- and retaining sufficient space for ventilation with the user's jaws clamped shut.

The present invention thus addresses the recognised essential properties for this device:

- occupying areas with no teeth;
- enabling an engagement of the mandibular and maxillary dental arches;
- being comfortable;

not exhibiting any protrusions or roughness;

being retentive;

absorbing and dissipating impact energy;

enabling phonation;

enabling oral ventilation with the jaws clamped shut.

Advantageously, the pallet has at least one arm having a free end, for example two arms, comprising a lug, preferably at the free end, said lug being suitable for being inserted into a slot provided for this purpose in the adaptable structure, preferably at an occlusal rim, to hold the mouthguard in position during the adaptation phase, and said lug potentially coming into contact with the frame.

Advantageously, the pallet has a rim in the form of an arc, preferably at the first region, suitable for butting against the incisor-canine area. The abutment created by this rim facilitates the positioning of the lugs in the slots thereof during the positioning of the pallet. Furthermore, the combined presence of the rim in the form of an arc and the pins makes it possible to maintain correct positioning of the pallet during the adaptation phase, correct positioning of the pallet being required so that the adaptable material of the splints does not block the ventilation space during mouthguard adaptation.

Advantageously, the pallet has a gripping region, for example, to enable the removal thereof after shaping the mouthguard.

According to one example of an embodiment, the mouthguard has an aperture, for example defined by the frame and the lower splint, wherein the pallet may be inserted.

Indeed, either before shaping, the pallet is inserted into a special aperture to maintain sufficient ventilation space, or once the adaptable structure has been softened to adapt same to a user's mouth, the pallet creates or increases a space by penetrating the softened adaptable material. In the case wherein the mouthguard initially has an aperture, a number of embodiments may be envisaged.

According to a first embodiment, the lower splint exhibits a discontinuity in the incisor-canine area. This discontinuity thus forms an aperture wherein the pallet is positioned, thus butting against the frame, but not necessarily in direct contact with the frame. The presence of this pallet thus prevents the space from being blocked at least partially during the adaptation of the mouthguard by a user.

According to a second embodiment, the lower splint is continuous all along the mandibular dental arch; the frame and the lower splint form together, at the interface thereof, an aperture wherein the pallet can be inserted. In this way, the mandibular teeth of the incisor-canine area can also be protected and the ventilation space retained during the adaptation phase.

According to a further example of an embodiment, the adaptable structure comprises an upper vestibular flap defining the upper splint for receiving the maxillary dental arch.

According to a further example of an embodiment, the adaptable structure comprises a lower vestibular flap defining the upper splint for receiving the mandibular dental arch.

Advantageously, the frame comprises a fixing cradle, for example in the incisor-canine area. This cradle may be used, for example, to attach the mouthguard to an American football helmet grid.

Advantageously, the frame comprises front reinforcements. These front reinforcements, preferably situated in the upper incisor-canine area, particularly make it possible to retain the position and thickness of the upper vestibular flap.

It may also be envisaged that the frame comprises side reinforcements, situated, preferably, at the upper and/or lower outer edges of the lateral sectors.

The front and side reinforcements are thus suitable for guiding the correct positioning of the user's maxillary and mandibular dental arches in the upper (maxillary) and lower (mandibular) splints of the adaptable structure during the mouthguard adaptation phase to the subject's morphology.

According to a further example of an embodiment, the frame comprises at least one securing hole, preferably situated in one of the lateral sectors, for securing the frame in the adaptable structure. In this way, during mouthguard manufacture, generally by moulding, the holes in the frame enable superior integration of the frame in the adaptable material of the adaptable structure.

According to a further example of an embodiment, the front reinforcements are interconnected by a joining element, thus defining spaces. These spaces are suitable, similar to the holes for securing the lateral sectors, for securing the frame in the adaptable structure in the incisor-canine area, and holding the shape of the upper vestibular flap.

The present invention further comprises a method for use.

A first preliminary step consists of rendering the adaptable structure malleable, for example, by placing the mouthguard in hot water. During this step, the pallet is positioned at the position thereof to hold the mouthguard and retain the minimum dimensions of the ventilation space.

Once the adaptable structure has become malleable, a second step consists of placing the mouthguard in the user's mouth while clamping the jaws shut and optionally pressing on the mouthguard with the fingers and tongue so that the mouthguard takes the shape of the intraoral surfaces.

Subsequently, a third step consists of removing the mouthguard from the mouth. Preferably, the user waits for a few seconds before removing the mouthguard from the mouth so that the adaptable structure is no longer deformed.

The mouthguard may be reshaped as required at any time if the user deems this to be necessary, by repeating the above steps.

Finally, when the adaptable structure has been shaped, a fourth step consists of removing the pallet from the mouthguard. The user can then reposition the mouthguard in the mouth to check the adaptation, and, if required, repeat the above steps.

In the first embodiment wherein the ventilation space is essentially formed by a discontinuity of the lower splint, the pallet is removed by disengaging the lugs from the free ends of the arms of the slots provided for this purpose in the adaptable structure.

In the second embodiment wherein the ventilation space is formed between the lower splint and the frame, the lugs of the free ends of the arms are firstly disengaged from the slots provided for this purpose in the adaptable structure and the arms are clamped further together by elastic deformation, and the pallet is then removed via the ventilation space.

In this way, in this second embodiment, the pallet may have a more notched geometry at the junction between the arms to facilitate the elastic deformation thereof.

BRIEF DESCRIPTION OF THE DRAWINGS

The invention, according to one preferential embodiment, will be understood and the advantages thereof will emerge more clearly on reading the detailed description hereinafter, given as an indication and not for the purposes of limitation, with reference to the appended figures presented hereinafter.

The identical elements represented in FIGS. 1 to 11 are identified with identical reference numbers.

DETAILED DESCRIPTION OF THE PREFERRED EMBODIMENT(S)

Figure 1:
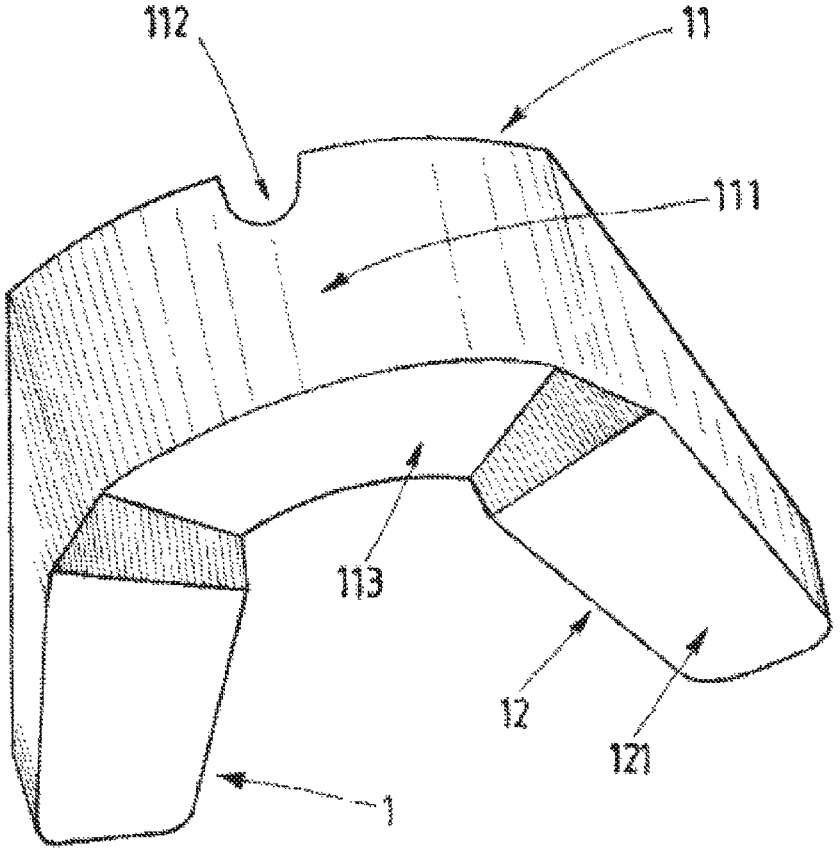
FIG. 1 *a*) is a front and bottom view of a mouthguard according to the invention according to a first embodiment, FIG. 1 *b*) is a front and bottom view of a mouthguard according to the invention according to a second embodiment.
Figure 1:
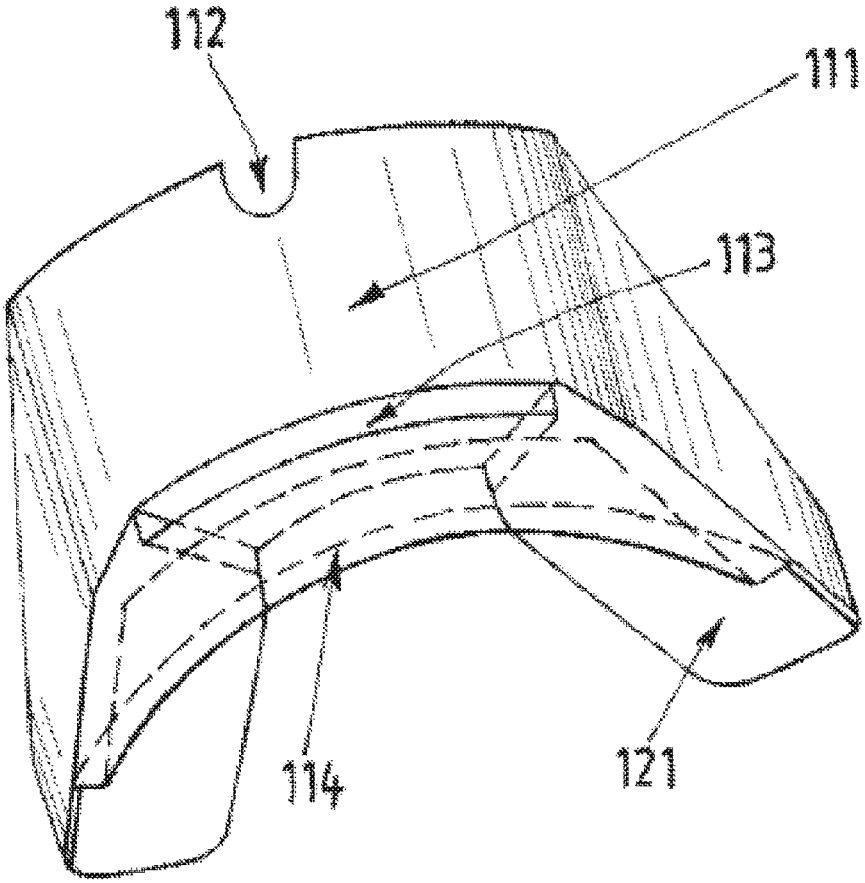
Figure 2:
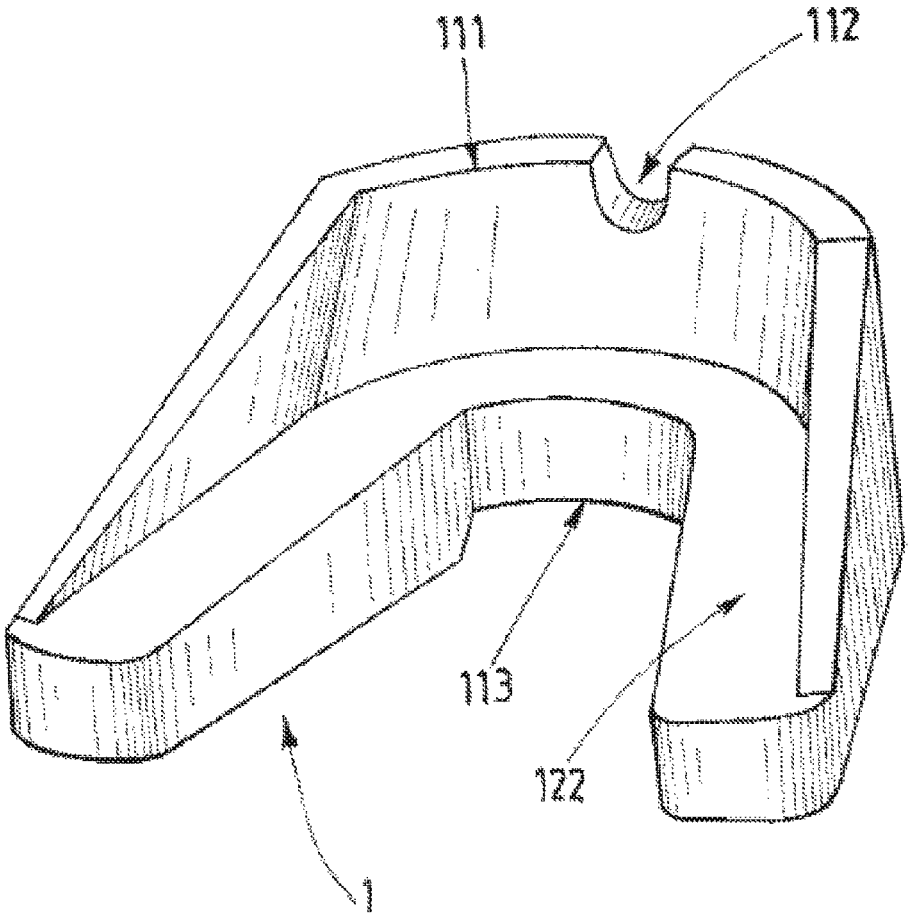
FIG. 2 is a rear and top view of the mouthguard in FIG. 1 *a*)
Figure 3:
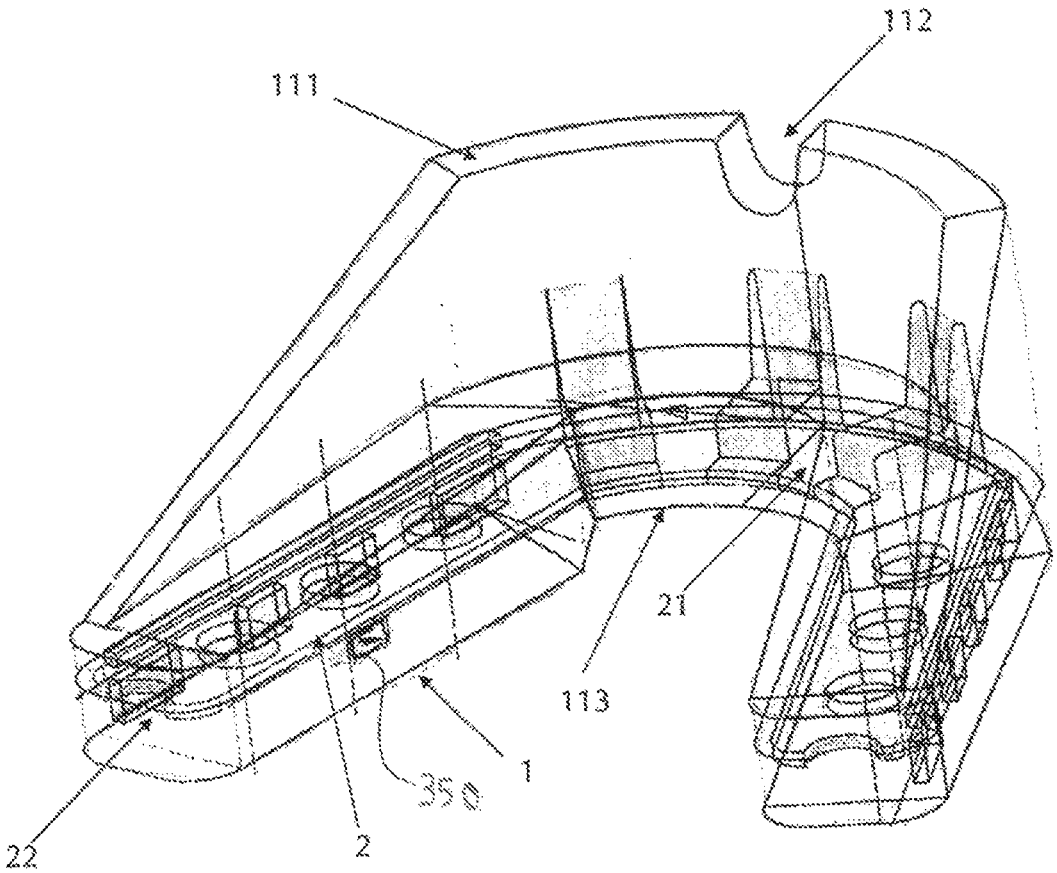
FIG. 3 is a transparent view of the mouthguard in FIG. 2, showing the position of the frame.
Figure 4:
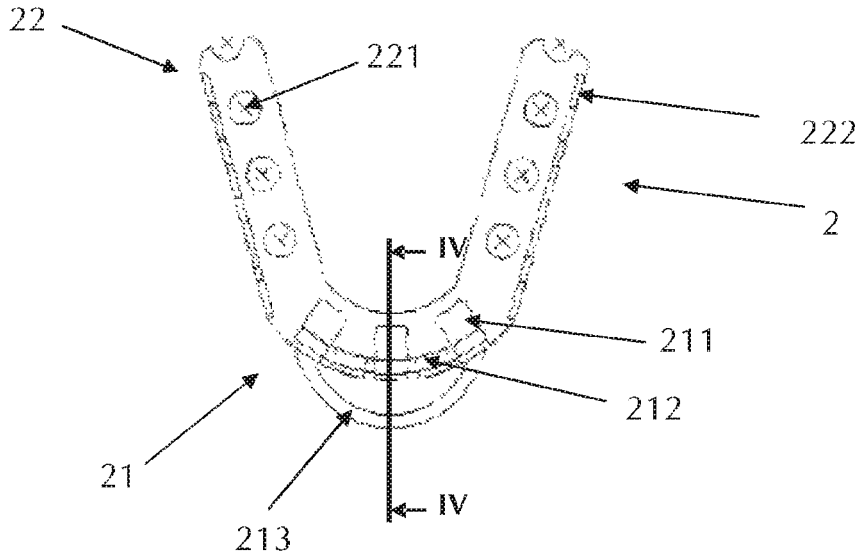
FIG. 4 is a plane top view of the frame.
Figure 5:
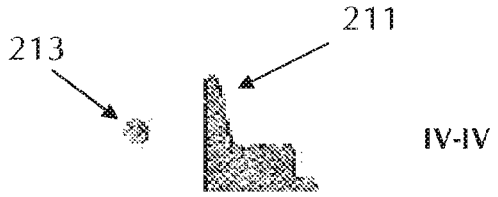
FIG. 5 represents a sectional view of the skeleton in FIG. 4 along the axis IV-IV.

The mouthguard according to the invention comprises an adaptable structure 1 and a frame 2.

A mouthguard is generally shaped in the form of the dental arch, i.e. it has an arc region forming the incisor-canine area and two lateral sectors corresponding to the positions of the premolars and molars.

The adaptable structure 1 is made of an adaptable material, i.e. a material that should enable the user to adapt the mouthguard to the user's orodental morphology, for example by means of a thermo-adaptation technique with hot water.

In the first embodiment describes, the adaptable structure 1 has an upper splint 122 for receiving the maxillary dental arch, and a lower splint 121 for receiving the mandibular dental arch. The shape of the maxillary 122 and mandibular 121 splints of the adaptable structure 1 is suitable for filling any spaces without teeth during the mouthguard adaptation phase to the user's orodental morphology.

The adaptable structure 1 has an incisor-canine area 11 connecting two lateral sectors 12 (one left and one right). When the mouthguard is in the mouth, the incisor-canine area 11 is situated at the upper (maxillary) and lower (mandibular) canines and incisors, and the two lateral sectors 12 are situated on either side, at the upper (maxillary) and lower (mandibular) premolars and molars.

The adaptable structure 1 further comprises an upper vestibular flap 111, defining the upper splint 122 for receiving the maxillary dental arch.

Advantageously, the upper vestibular flap 111 has a notch 112 facilitating the position of the upper lip stop.

The adaptable structure 1 may, according to a second embodiment shown in FIG. 1 *b*), also comprise a lower vestibular flap 114, in this case defining the lower splint 121 for receiving the mandibular dental arch.

According to a first example of an embodiment, the adaptable structure 1 has an aperture 113, defined by the frame 2 and the discontinuous lower splint 121 (or the lower vestibular flap 114 in the case of the second embodiment), wherein a pallet 3 for retaining a sufficient ventilation space during the shaping of the mouthguard, while retaining the minimum thicknesses, may be inserted.

The shape of the adaptable structure 1, in this case, matches the standardised orodental morphology (depth of upper (maxillary) 111 and lower (mandibular) 114 vestibular flaps if it exists, position of notch 112, arch width and length, etc.).

The frame 2 is included in the adaptable structure 1. It preferably consists of a material having a non-modifiable texture (or suitable for modelling) using the recommended technique for adapting the adaptable structure 1 to the user's orodental morphology (thermo-adaptation technique with hot water or other techniques).

In this way, during adaptation in the mouth after softening the adaptable structure 1, the frame 2 is suitable for retaining, in regions at risk of injuries, the minimum material thicknesses required for absorbing and dissipating the energy of the traumatic impact.

The frame 2 also has an incisor-canine area 21 and two lateral sectors 22 (one left and one right). As for the adaptable structure 1, when the mouthguard is in the mouth, the incisor-canine area 11 is situated at the upper (maxillary) and lower (mandibular) canines and incisors, and the two lateral sectors 12 are situated on either side, at the upper (maxillary) and lower (mandibular) premolars and molars.

According to this example of an embodiment, the frame 2 has a plurality of reinforcements.

In the incisor-canine area 21, the frame 2 has three front reinforcements 211, but not necessarily exclusively. The shape and position of these front reinforcements 211 firstly enables the mouthguard to retain a sufficient thickness at the incisors and canines and then helps retain the shape of the upper vestibular flap 111 when the material of the adaptable structure has been softened, so as to guide the correct positioning of the maxillary incisors during the adaptation procedure.

According to one example of an embodiment, the front reinforcements 211 of the incisor-canine area 21 are interconnected by a joining element 212 for reinforcing the interlocking of the front reinforcements 211 and retaining the upper vestibular flap 111.

The frame 2 also comprises upper 222 and lower 223 side reinforcements, preferably at the outer edges of the lateral sectors 22.

Figure 6:
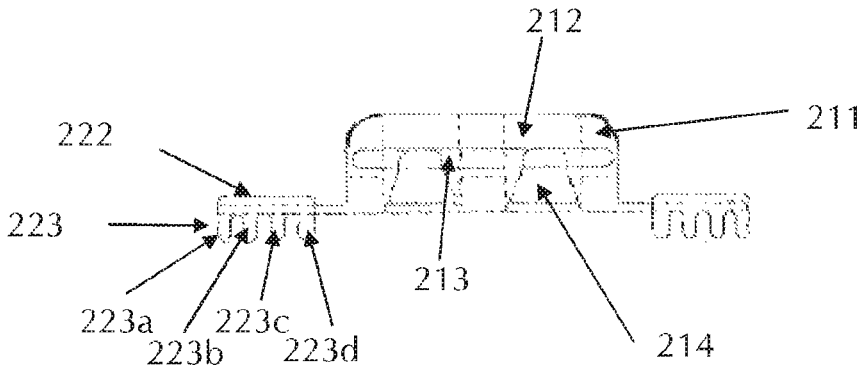
FIG. 6 is a front view of the frame in FIG. 4.
Figure 7:
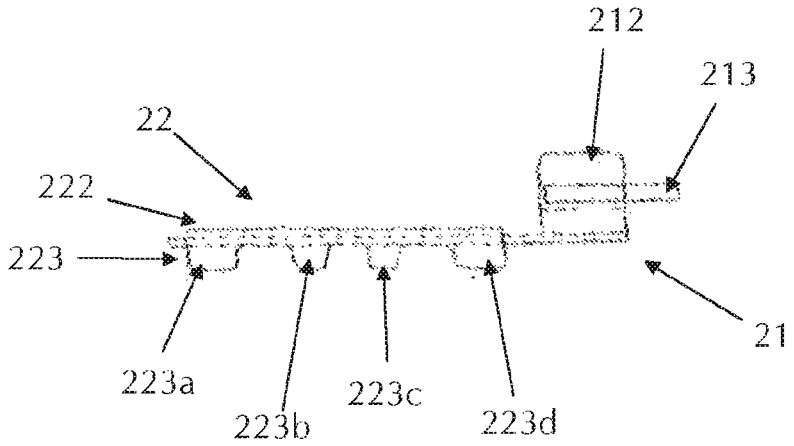
FIG. 7 is right-hand side view of the frame in FIG. 4, FIG. 8*a*) is a plane top view of a pallet according to a first embodiment, FIG. 8*b*) is a plane top view of a pallet according to a second embodiment.

These upper 222 and lower 223 side reinforcements may be a continuous strip of material or blocks. In the example illustrated in FIG. 6, the frame 2 comprises upper side reinforcements 222 in the form of a continuous strip, and lower side reinforcements (223*a*, 223*b*, 223*c*, 223*d*) in the form of blocks.

The frame 2 also comprises securing holes 221 in the lateral sectors 22, or spaces 214 in the incisor-canine area 21 if a joining element 2121 is present. Indeed, according to a preferential embodiment, the frame 2 is produced, for example, by moulding, and the adaptable structure 1 is obtained by moulding. The presence of the securing holes 221 in the lateral sectors 22 of the frame 2, or in some cases, of the spaces 214 in the incisor-canine area, enables superior integration of the frame 2 in the adaptable material of the adaptable structure 1.

According to a further example of an embodiment, the frame 2 also comprises a cradle 213 in the incisor-canine area 21, which may be used to attach the mouthguard to an American football helmet grid for example.

The mouthguard further comprises a removable pallet 3 preferably made of a rigid material having a non-modifiable texture (or suitable for modelling) using the recommended technique for adapting the adaptable structure 1 to the user's orodental morphology (thermo-adaptation technique with hot water or other techniques).

The adjustment of the pallet 3 with the frame 2 helps guide the user's maxillary dental arch in the upper (maxillary) splint 122 of the adaptable structure 1 during the mouthguard adaptation phase to the subject's orodental morphology.

The pallet 3 essentially has a first region 33 suitable for engaging with the frame 2 to retain a sufficient ventilation space while retaining the thicknesses of the guard.

Figure 8A:
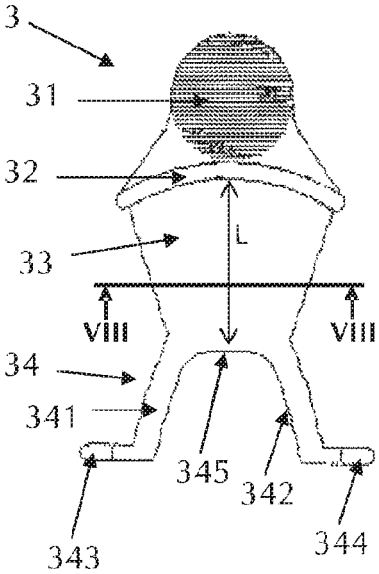
Figure 8B:
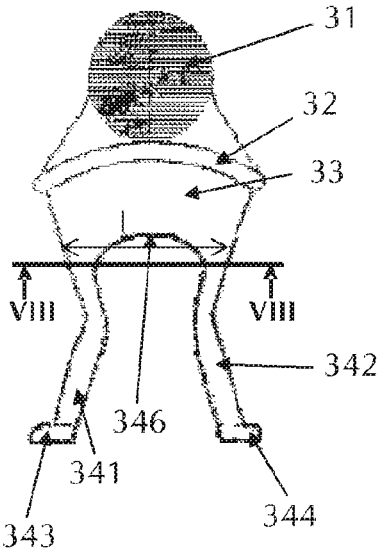
Figure 9:
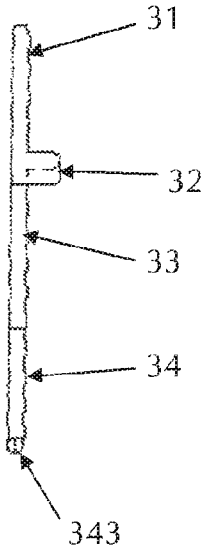
FIG. 9 is a profile view of the pallets illustrated in FIGS. 8*a*) and 8*b*)
Figure 10:
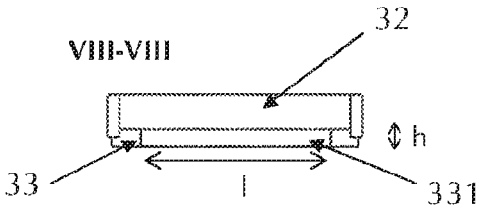
FIG. 10 is a front view of the pallets illustrated in FIGS. 8*a*) and 8*b*)
Figure 11:
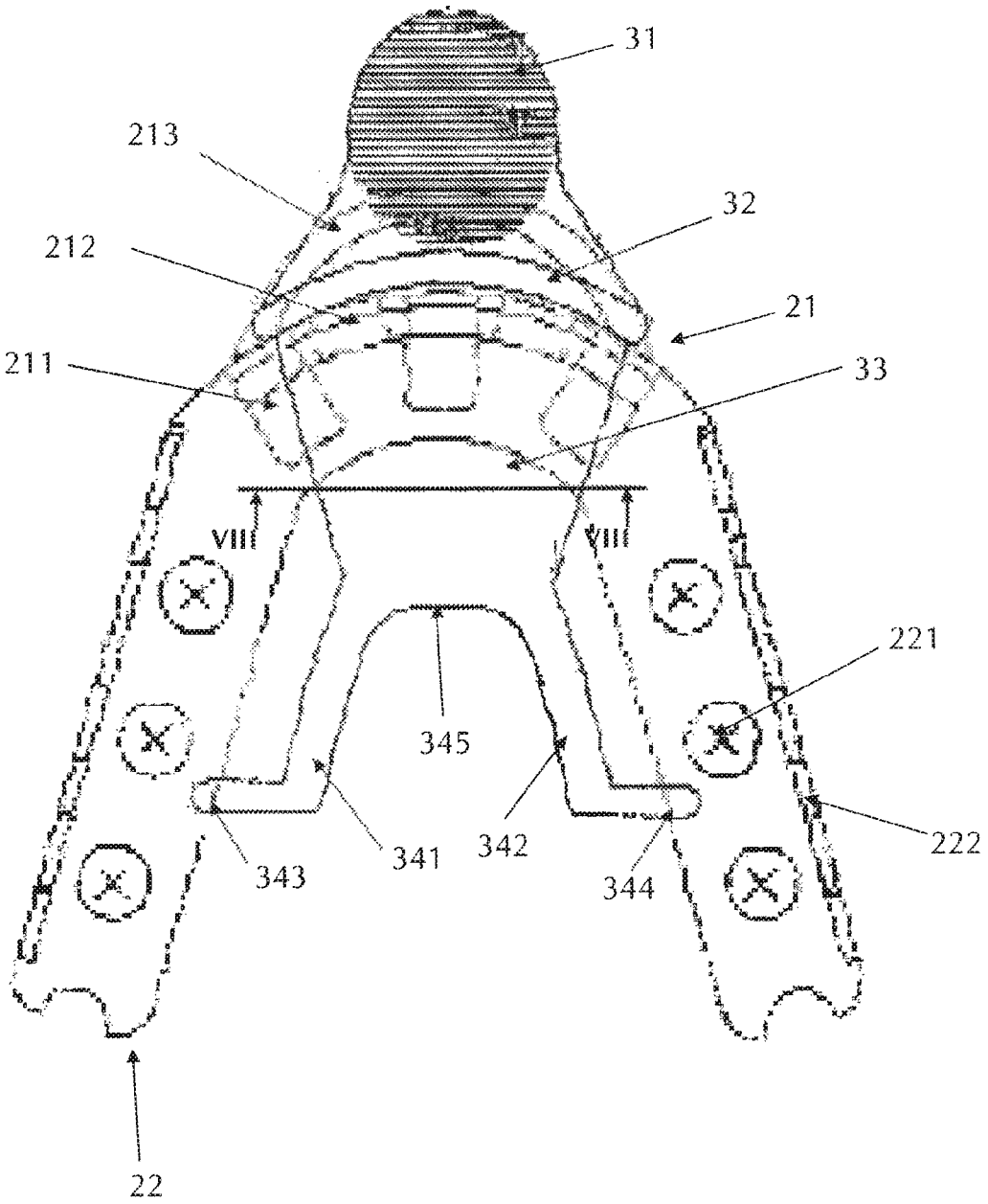
FIG. 11 is a schematic view of the position of the pallet in FIG. 8*a*) with respect to the frame.

Said region 33 is dimensioned such that, during the mouthguard adaptation phase, the positioning of this region 33 in the incisor-canine area, in the space 113 if it exists, and engaging with the frame 2, makes it possible to retain, or create or enlarge, a frontal ventilation space of a sufficient size during the mouthguard adaptation phase to the user's orodental morphology, so that the user can benefit from effective ventilation with the jaws clamped shut, for example during a sports activity. This first region 33 particularly has, in the intersection region between the pallet 3 and the incisor-canine area (when the pallet 3 is positioned for mouthguard adaptation), a cross-section 331 defined by a minimum width 1 and height h (FIGS. 8 *a*), 8 *b*), 10 and 11). The dimensions of the ventilation space are thus ensured by the dimensions of the smaller cross-section 331 of the first region 33. The ventilation space 113 is the space realized by the removable pallet 3 once the pallet 3 has been removed after shaping the mouthguard. In FIGS. 1*a*, 1*b*, 2 and 3 the ventilation space take place of the space 113 after shaping the mouthguard, once the positioning of the region 33 in space 113 has retained or enlarged a ventilation space. In FIG. 11, the ventilation space takes place of the region 33 once the pallet has been removed after shaping of the mouthguard.

Advantageously, this cross-section 331 should be devised so as to retain, after the mouthguard shaping procedure, a frontal ventilation space having a cross-section approximately greater than or equal to 30 square millimeters.

For example this cross-section 331 is designed to allow the passage of a template having the following dimensions, after shaping:

height h: 2 mm, width l: 15 mm.

The pallet 3 has, according to one preferential example of an embodiment, two arms 34, one left arm 341 and one right arm 342, each ending with a lug (343, 344), each lug (343, 344) being suitable for being inserted into slots 350 provided for this purpose in the lateral sectors 12 of the adaptable structure 1 and butting against the lateral sectors 22 of the frame 2 (not necessarily in direct contact), to hold the pallet 3 in position during the mouthguard adaptation phase.

The junction (345 or 346) of these two arms 341 and 342 may take various forms: for example, the junction 345 would be more rigid than the junction 346. The junction 346 is suitable, for example, for facilitating the insertion and extraction of the pallet when the space 113 is formed at the interface between the continuous lower splint 121 and the frame 2 (for example, when the mouthguard is produced according to the second embodiment).

The pallet 3 also has a rim 32 in the form of an arc which is, preferably, specifically adjusted to the rim of the incisor-canine area 11 of the adaptable structure 1 to facilitate the positioning of the lugs (343, 344) in the slots 350 during shaping in the mouth, and thus hold the position of the region 33 for example during the adaptation phase.

Advantageously, the pallet 3 has a gripping region 31.

Finally, the mouthguard may be produced using conventional methods. In particular, the frame, produced for example by moulding, is positioned in a mould wherein the material of the adaptable structure is injected. Consequently, the adaptable structure may eventually have small holes corresponding to blocks present in the mould to hold the frame in place when injecting the material of the adaptable structure.

Naturally, various alternative embodiments are possible, without leaving the scope of the invention.

The invention claimed is:

1. A mouthguard, suitable for being shaped in the mouth, comprising:

an adaptable structure, consisting of an adaptable material having an upper splint for receiving a maxillary dental arch and a lower splint for receiving a mandibular dental arch, a frame a portion of which is covered by the adaptable structure, said frame consisting of a non-adaptable material, the adaptable structure and the frame being arranged to form an incisor-canine guard area at least at the upper canines and incisors, and an occlusal rim at each lateral dental sector, a removable pallet, consisting of a non-adaptable material comprising a first region intended to butt against the frame, said first region of the pallet being dimensioned such that, during the mouthguard adaptation phase, a combined presence of said pallet and said frame ensures both a ventilation space and a presence of sufficient adaptable material in the incisor-canine area.

2. The mouthguard according to claim 1, wherein the first region of the pallet has a cross-section having a surface area greater than or equal to 30 square millimeters.

3. The mouthguard according to claim 1, wherein the pallet has an arm, comprising a lug, said lug being suitable for being inserted into a slot provided in the adaptable structure.

4. The mouthguard according to claim 1, wherein the pallet has a rim in the form of an arc, suitable for butting against the incisor-canine area.

5. The mouthguard according to claim 1, wherein the pallet has a gripping region.

6. The mouthguard according to claim 1, further comprising an aperture wherein the pallet can be inserted.

7. The mouthguard according to claim 1, wherein the adaptable structure comprises an upper vestibular flap defining the upper splint.

8. The mouthguard according to claim 1, wherein the frame comprises a fixing cradle.

9. The mouthguard according to claim 1, wherein the frame comprises front reinforcements.

10. The mouthguard according to claim 1, wherein the frame comprises side reinforcements.

11. The mouthguard according to claim 1, wherein the frame comprises a securing hole for securing the frame in the adaptable structure.

* * * * *